United States Patent [19]

Stewart

[11] 4,052,061

[45] Oct. 4, 1977

[54] RACKET WEIGHTING MEANS

[76] Inventor: Samuel F. Stewart, 1119 Fleetwood Drive, Carlisle, Pa. 17013

[21] Appl. No.: 688,955

[22] Filed: May 24, 1976

Related U.S. Application Data

[60] Division of Ser. No. 596,038, July 11, 1975, Pat. No. 4,005,864, which is a continuation-in-part of Ser. No. 521,177, Nov. 6, 1974, abandoned.

[51] Int. Cl.[2] ..... A63B 69/38; A63B 49/04

[52] U.S. Cl. ..... 273/73 R; 273/29 A

[58] Field of Search ..... 273/26 B, 29 A, 54 B, 273/72 R, 73 R, 73 C, 73 F, 73 G, 73 H, 73 J, 81 A, 162 R, 171, 193 R, 193 A, 194 R, 194 B, DIG. 19; 272/96; 128/25 B, 166, DIG. 15

[56] References Cited

U.S. PATENT DOCUMENTS

| | | | |
|---|---|---|---|
| 2,395,864 | 3/1946 | Geerlings | 273/73 G |
| 2,608,409 | 8/1952 | Pinkerton | 273/72 R X |
| 2,932,514 | 4/1960 | Bergmark | 273/73 R |
| 3,000,384 | 9/1961 | Piers | 128/DIG. 15 |
| 3,105,972 | 10/1963 | Christopher | 128/DIG. 15 |
| 3,209,517 | 10/1965 | Hyman | 128/DIG. 15 |
| 3,224,774 | 12/1965 | Klotz | 273/DIG. 19 |
| 3,330,560 | 7/1967 | Higdon | 273/73 R |
| 3,334,898 | 8/1967 | McCrory et al. | 272/96 X |
| 3,525,141 | 8/1970 | Smith | 272/96 X |
| 3,642,283 | 2/1972 | Wilkens | 273/73 G |
| 3,880,161 | 4/1975 | Fossel | 128/DIG. 15 |
| 4,000,893 | 1/1977 | Evans | 273/73 R X |

FOREIGN PATENT DOCUMENTS

| | | | |
|---|---|---|---|
| 848,826 | 8/1970 | Canada | 273/73 F |
| 1,376,724 | 9/1964 | France | 273/73 C |
| 6,456 of | 1885 | United Kingdom | 273/73 G |

*Primary Examiner*—Richard J. Apley
*Attorney, Agent, or Firm*—Lee & Smith

[57] ABSTRACT

An improved racket weighting device for use with any existing racket having a shaft with a throat connected to a frame during warm-up, practice or actual play in sports such as tennis, badminton, squash or the like. The device includes a non-continuous flexible member adapted to be wrapped at least one time around the throat of the racket, supplemental weight integrally associated with the member, the hooks, self-adhering synthetic fabric fasteners or the like for securely attaching the member to the racket. The improved racket weighting device is particularly useful for temporarily adding supplemental weight to a racket in order to develop a better shot by strengthening the critical parts of the arm.

5 Claims, 7 Drawing Figures

RACKET WEIGHTING MEANS

RELATED APPLICATION

This application is a division of applicant's copending U.S. patent application Ser. No. 596,038, filed July 11, 1975, now U.S. Pat. No. 4,005,864 which in turn is a continuation-in-part of applicant's U.S. patent application Ser. No. 521,177, filed Nov. 6, 1974 and now abandoned.

BACKGROUND OF THE INVENTION

The present invention relates to an improved racket weighting means and more particularly to a device for use with any existing racket having a shaft with a throat connected to a frame during warm-up, practice, or actual play in sports such as tennis, badminton, squash or the like to provide means for temporarily adding supplemental weight to the racket in order to develop a better shot by strengthening the critical parts of the arm.

Specific weight training programs have been utilized for many years to strengthen the critical parts of the body for a wide variety of sports. Initially, such programs included the use of weights independent of participation in a particular sport. Subsequently, weighted sports equipment was developed and weight training programs included the use of such equipment during warm-up, practice or actual play in a particular sport. Weighted baseball bats, golf clubs and tennis rackets have all been used for this purpose with a considerable degree of success. While the use of weights independent of participation has been found to be effective to generally strengthen the body, the use of weighted sports equipment during warm-up, practice or actual play has been found to be effective to specifically strengthen the critical parts of the body for a particular sport.

Weighted sports equipment has taken many forms. In its most basic form, such equipment has included a baseball player swinging two or three bats during warm-up prior to practice or actual play. Also, such equipment has included devices such as those disclosed in U.S. Pat. Nos. 2,608,409; 3,608,907; 3,647,220; and, 3,716,239 which are designed to add weight to the shaft of a golf club during warm-up, practice or actual play. Finally, such equipment has included devices such as those disclosed in U.S. Pat. Nos. 1,186,283; 2,395,864; 2,546,140; 3,330,560; and 3,642,283 designed to add weight to the frame or shaft of a tennis racket during warm-up, practice or actual play.

While these examples of weighted sports equipment recognize the desirability of the use of such equipment for a wide variety of sports, the improved racket weighting means of the present invention provides a significant advance over all of such prior art devices.

SUMMARY OF THE INVENTION

With the present invention, an improved racket weighting means for use with any existing racket having a shaft with a throat connected to a frame is provided. The device includes a non-continuous flexible member adapted to be wrapped at least one time around the throat of the racket, supplemental weight integrally associated with the member, and means for attaching the member to the racket. The improved racket weighting means is useful typically to provide means for temporarily adding supplemental weight to the racket during warm-up, practice or actual play in order to develop a better shot by strengthening the critical parts of the arm.

Accordingly, it is an object of the present invention to provide an improved racket weighting means for use with any existing racket having a shaft with a throat connected to a frame during warm-up, practice, or actual play.

It is a further object of the present invention to provide an improved racket weighting means for temporarily adding supplemental weight to any existing racket in order to develop a better shot by strengthening the critical parts of the arm.

It is an additional object of the present invention to provide an improved racket weighting means for controlling the moment of inertia, center of balance, weighting, flexibility and other physical properties of any existing racket.

These and other objects, advantages and features of the present invention will be apparent from a consideration of the accompanying drawings, specifications and claims.

DESCRIPTION OF THE PREFERRED EMBODIMENT

First Embodiment

Figure 3:
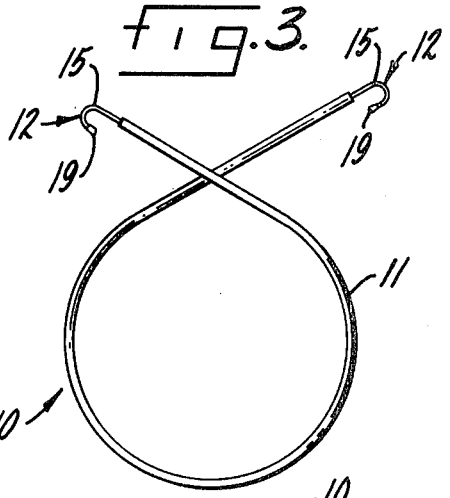
FIG. 3 is a perspective view of a first embodiment of the improved racket weighting means of the present invention.

The general nature of the first embodiment of the present invention may be understood by referring to FIG. 3 in which the improved racket weighting means 10 includes a non-continuous flexible elongated member 11 and means 12 for attaching the member 11 to any existing racket having a shaft with a throat connected to a frame. The member 11 is adapted to be wrapped at least one time around the throat of the racket and means 12 is adapted to attach the member 11 to the throat or frame of the racket.

Figure 4:
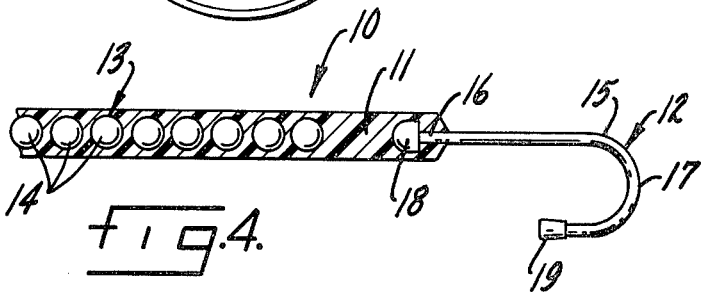
FIG. 4 is an axial section of a portion of a first embodiment of the improved racket weighting means of the present invention.

Referring to FIG. 4, the first embodiment of the improved racket weighting means 10 can be more fully understood. The non-continuous flexible elongated member 11 is preferably constructed of an elastic material which is capable of being stretched and recovering its original size and shape indefinitely and is also capable of being wrapped a plurality of times around the throat of the racket when it is stretched. Integrally associated with the member 11 is supplemental weight 13 which is advantageously internally disposed. The internally disposed supplemental weight 13 preferably includes a plurality of integrally molded weight members 14.

In practice, it has been found to be advantageous to construct the weight members 14 of lead or steel in a generally spherical shape and to longitudinally space the weight members 14 within the elastic material of the member 11. With this construction, the member 11 is easily capable of being stretched and of recovering its original size and shape indefinitely and is also easily capable of being wrapped a plurality of times around the throat of the racket when it is stretched. However, it will be understood that it is also acceptable for the member 11 and the supplemental weight 13 of the first embodiment of the improved racket weighting means 10 to be constructed of other suitable materials and designs exhibiting these same general characteristics.

Referring to FIG. 3, means 12 for attaching the member 11 to the throat or frame of the racket in the first embodiment of the improved racket weighting means 10 includes a pair of hooks 15. One of the hooks 15 is attached to one end of the member 11 and the other of the hooks 15 is attached to the other end of the member 11. The hooks 15 can then be fastened to the frame of the racket, to the throat of the racket, or to each other in order to attach the member to the racket.

Referring to FIG. 4, one of the hooks 15 is shown in greater detail. The hook 15 shown has a first portion 16 for attaching the hook to one end of the member 11 and also has a second portion 17 which is bent in a generally U-shape for attaching the member 11 to the racket. The first portion 16 of the hook 15 preferably includes a retainer plug 18 which is internally disposed in one end of the member 11 and the second portion 17 preferably includes a rubber tip 19 inserted on the end of the generally U-shape portion. The hook 15 is also preferably constructed of steel which has been plastic coated. It will be understood, of course, that the other of the hooks 15 is identical in construction and assembly to the one shown in FIG. 4. With these features, the pair of hooks 15 are adapted to securely attach the member 11 to the throat or frame of the racket without any possibility of damage to the racket surface.

With the unique construction of the first embodiment of the present invention, the improved racket weighting means 10 is easy and inexpensive to manufacture using modern molding techniques. The weight members 14 can be integrally molded so as to be longitudinally spaced and confined within the elastic material of the member 11, and the retainer plugs 18 can be integrally molded so as to be cooperatively retained within the elastic material of the member 11. As a result, all of the elements form a wholly integral device, and there are no elements which can become separated or lost. Accordingly, the first embodiment of the improved racket weighting means 10 of the present invention is a simple yet highly useful and effective device.

Figure 1:
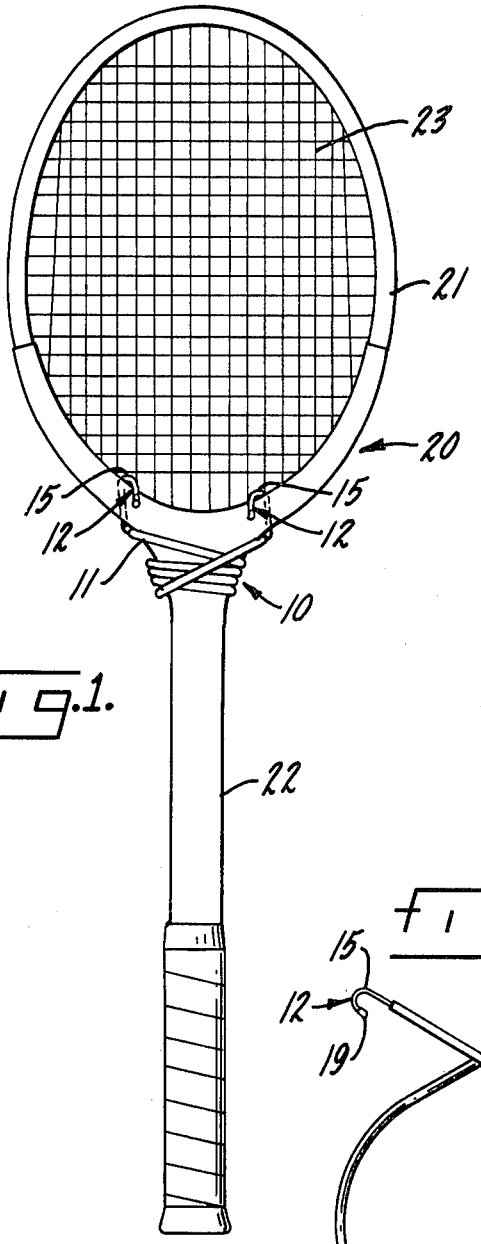
FIG. 1 is a front elevation of a typical wooden racket with a first embodiment of the improved racket weighting means of the present invention attached.
Figure 2:
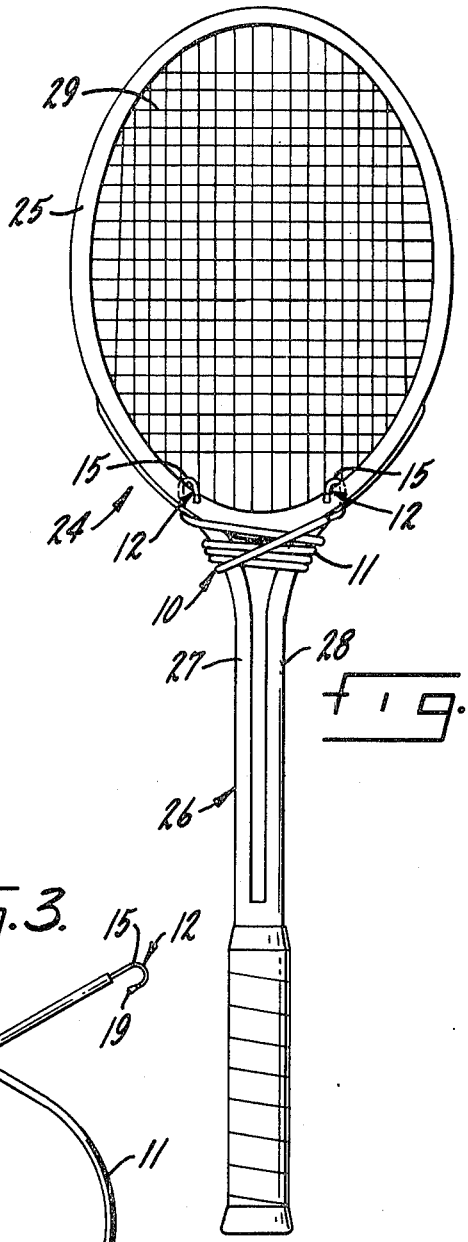
FIG. 2 is a front elevation of a typical metal racket with a first embodiment of the improved racket weighting means of the present invention attached.

Referring to FIGS. 1 and 2, use of the first embodiment of the improved racket weighting means 10 of the present invention can best be understood. In FIG. 1, the improved racket weighting means 10 is shown in a ready-for-use position on a typical wooden tennis racket 20 having a shaft 22 with a throat connected to a frame 21. To place the improved racket weighting means 10 in a ready-for-use position on the racket 20, one of the hooks 15 can be attached to one side of the frame 21 near the throat of the shaft 22. Next, the non-continuous flexible elongated member 11 can be stretched slightly and snuggly wrapped at least one time around the throat of the shaft 22 near the frame 21. Finally, the member 11 can be stretched further and the other of the hooks 15 can be attached to the other side of the frame 21 near the throat of the shaft 22. Of course, depending on the exact location of the hooks 15 on the frame 21, each of the hooks 15 will have a tendency to slide down the frame 21 toward the throat of the shaft 22 until it rests against one of the strings 23. Then the first embodiment of the improved racket weighting means 10 is in a ready-for-use position for warm-up, practice or actual play.

In FIG. 2, the first embodiment of the improved racket weighting means 10 is shown in a ready-for-use position on a typical metal tennis racket 24 having a shaft 26 with a throat connected to a frame 25. The shaft 26 of the metal tennis racket 24 has a wider throat defined by the outward curvature of stems 27 and 28. Nevertheless, the first embodiment of the improved racket weighting means 10 can be attached to the metal tennis racket 24 in precisely the same manner as it was attached to the wooden tennis racket 20 shown in FIG. 1.

To place the improved racket weighting means 10 in a ready-for-use position on the racket 24, one of the hooks 15 can be attached to one side of the frame 25 near the throat of the shaft 26. Next, the non-continuous flexible elongated member 11 can be stretched slightly and snuggly wrapped at least one time around the throat of the shaft 26 defined by the outward curvature of the stems 27 and 28. Finally, the member 11 can be stretched further and the other of the hooks 15 can be attached to the other side of the frame 25 near the throat of the shaft 26. Of course, depending on the exact location of the hooks 15 on the frame 25, each of the hooks 15 will have a tendency to slide down the frame 25 until it rests against one of the strings 29. Then the first embodiment of the improved racket weighting means 10 is again in a ready-for-use position for warm-up, practice, or actual play.

It will be understood, of course, that the first embodiment of the improved racket weighting means 10 of the present invention can be placed in a ready-for-use position on typical wooden rackets 20 or typical metal rackets 24 in other equally acceptable ways. One of the hooks 15 can be attached directly to the throat of either type of racket, then the non-continuous flexible elongated member 11 can be stretched and snuggly wrapped at least one time around the throat, next the member 11 can be stretched further and finally the other of the hooks 15 can be attached directly to the throat. Similarly, one of the hooks can be held, then the non-continuous flexible elongated member 11 can be stretched and snuggly wrapped at least one time around the throat, next the member 11 can be stretched further and finally the other of the hooks 15 can be attached to the held hook to attach the member 11 to the throat of either type of racket. These and other ways are all equally acceptable for placing the first embodiment of the present invention in a ready-for-use position.

Second Embodiment

Figure 7:
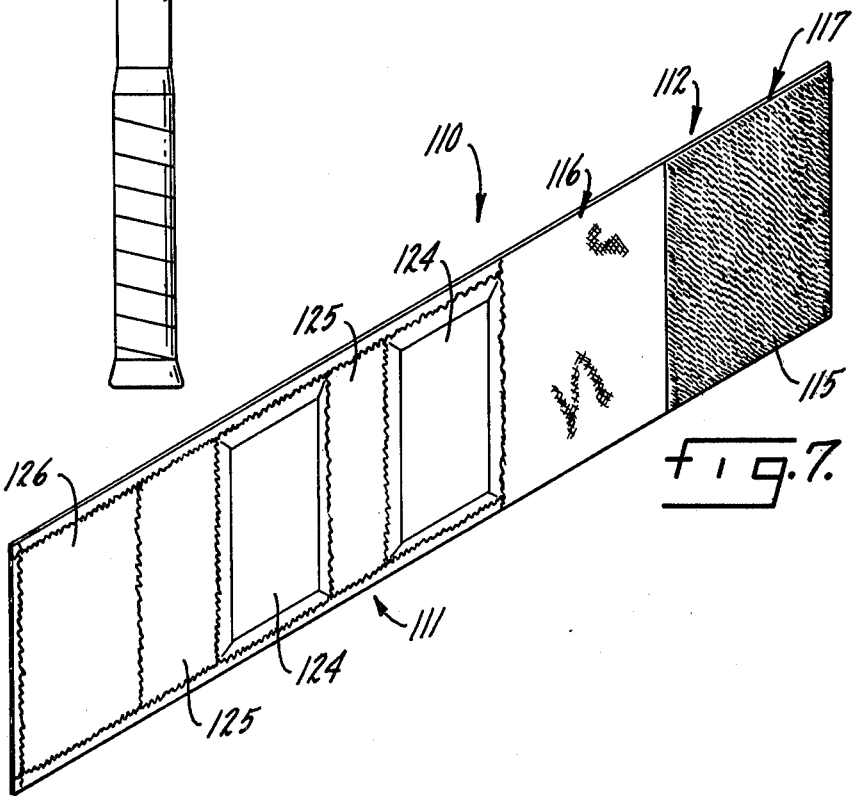
FIG. 7 is a perspective view of a second embodiment of the improved racket weighting means of the present invention.

The general nature of the second embodiment of the present invention may be understood by referring to FIG. 7 in which the improved racket weighting means 110 includes a non-continuous, flexible elongated member 111 and means 112 for attaching the member 111 to any existing racket having a shaft with a throat connected to a frame. The member 111 is adapted to be wrapped at least one time around the throat of the racket and means 112 is adapted to attach the member 111 to the racket.

Figure 6:
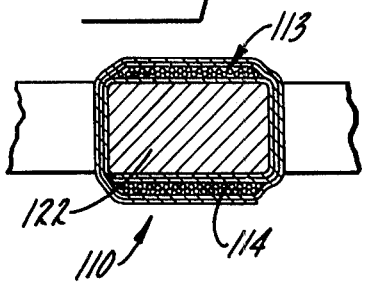
FIG. 6 is a cross-sectional view of a second embodiment of the improved racket weighting means of the present invention taken along the line 6—6 in FIG. 5.

The member 111 is preferably constructed of a material which is capable of being wrapped more than one time around the throat of the racket, and means 112 is preferably constructed of an elastic material which is capable of being stretched and recovering its original size and shape indefinitely. Integrally associated with the member 111 is supplemental weight 113 as shown in FIG. 6 which is advantageously internally disposed and which is preferably provided as a plurality of weight members 114. Means 112 is preferably constructed as an extension of the member 111 which is capable of being wrapped at least one time and preferably more than one time around the throat of the racket when it is stretched in order to attach the member with the internally disposed weight members 114 to the racket.

In practice, it has been found to be advantageous to construct each of the weight members 114 of lead or steel in a small generally spherical shape for positioning within the member 111. In order to accommodate the weight members 114, the member 111 is preferably constructed of two opposed elongated strips of material which are stitched, as shown in FIG. 7, to form weight segments 124, spacer segments 125 and dummy segment 126. The weight segments 124 and dummy segment 126 can advantageously be formed having a width which corresponds to an average width for the throats of both wooden and metal rackets, and the spacer segments 125 can advantageously be formed having a width which corresponds to an average depth for the throats of both wooden and metal rackets. The two strips of the member 111 are stitched with a slight space therebetween to form the weight segments 124 but are otherwise stitched closely together to form spacer segments 125 and dummy segment 126. The weight members 114 are positioned within the weight segments 124 during stitching, and the slight spaces between the two strips of the member 111 which form the weight segments 124 are completely enclosed by stitching with the weight members 114 so positioned. With this construction, the member 111 is flexible and conformable which easily facilitates wrapping it at least one time around the throat of the racket.

Referring to FIG. 7, means 112 for attaching the member 111 to a racket is shown in detail. Means 112 has a first portion 116 for attachment to the member 111 as an extension in longitudinal alignment and also has a second portion 117 for attachment of the member 111 to the racket. At least the first portion 116 of means 112 is preferably constructed of an elastic material and the second portion 117 is preferably constructed of a self-adhering synthetic fabric. The reverse side of means 112 is formed of a corresponding self-adhering synthetic fabric so that the second portion 117, together with the reverse side of means 112, form a self-adhering synthetic fabric fastener 115. With these features, means 112 is adapted to securely attach the member 111 to the throat of the racket without any possibility of damage to the racket surface.

With the unique construction of the second embodiment of the present invention, the improved racket weighting means 110 is easy and inexpensive to manufacture. The weight members 114 are stitched and confined within the two opposed elongated strips of material of the member 111 and the first portion 116 of means 112 is stitched to the member 111 as an extension in longitudinal alignment. As a result, all of the elements form a wholly integral device and there are no elements which can become separated or lost. Accordingly, the second embodiment of the improved racket weighting means 110 of the present invention is a simple yet highly useful and effective device.

Figure 5:
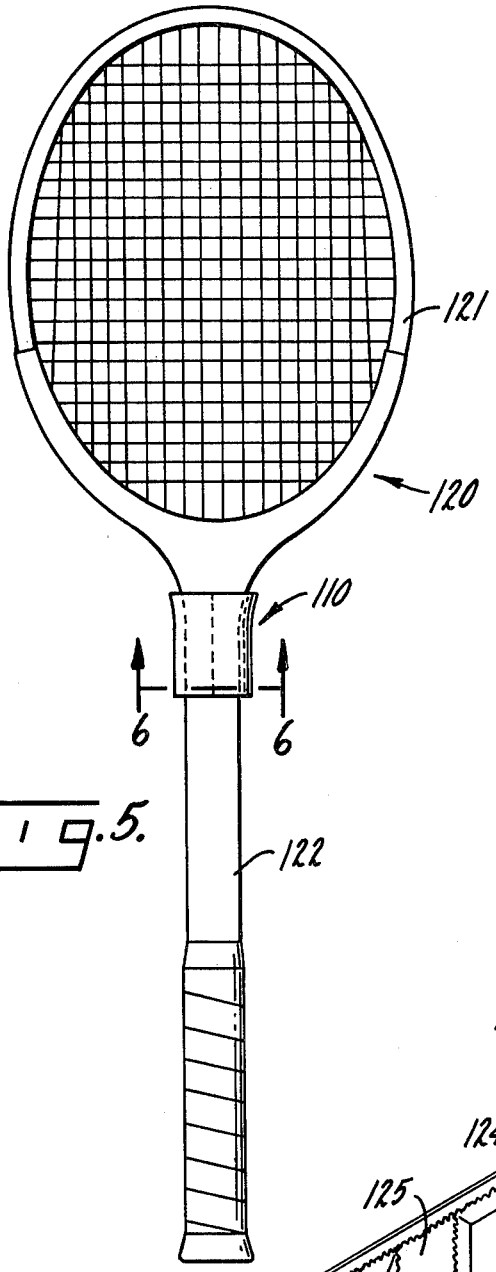
FIG. 5 is a front elevation of a typical wooden racket with a second embodiment of the improved racket weighting means of the present invention attached.

Referring to FIGS. 5 and 7, use of the second embodiment of the improved racket weighting means 110 of the present invention can best be understood. In FIG. 5, the improved racket weighting means 110 is shown in a ready-for-use position on a typical wooden tennis racket 120 having a shaft 122 with a throat connected to a frame 121. To place the improved racket weighting means 110 in a ready-for-use position on the racket 120, the dummy segment 126 is aligned with one of the faces of the throat of the shaft 122. Next, the member 111 is wrapped in continuous fashion around the throat of the shaft 122 so that the spacer segments 125 are aligned with the sides of the throat and the weight segments 124 are aligned with the faces of the throat. Finally, means 112 is stretched and wrapped in a continuous manner over the member 111 and the self-adhering synthetic fabric fastener 115 is utilized to attach the improved racket weighting means 110 to the racket 120 by bringing the fabric of the second portion 117 of means 112 into contact with the backside of means 112. Then, the second embodiment of the improved racket weighting means 110 is in a ready-for-use position for warm-up, practice or actual play.

It will be understood, of course, that the second embodiment of the improved racket weighting means 110 of the present invention can be placed in a ready-for-use position on either typical wooden rackets or typical metal rackets. To place the improved racket weighting means 110 in a ready-for-use position on either type of racket, the same procedure is followed. When the second embodiment of the improved weighting means 110 is in a ready-for-use position, it will be wrapped as shown in FIG. 6 and it will appear as shown in FIG. 5.

It will, of course, be understood that variations on the materials and design of the second embodiment of the improved racket weighting means 110 also come within the scope of the present invention. For instance, means 112 for attaching the member 111 to the racket can be integrally associated with the member 111 rather than as an extension in longitudinal alignment. Also, means 112 can comprise any of a large range of commonly known fasteners such as hooks, snaps, strings and the like. In addition, supplemental weight 113 can comprise solid weight internally disposed in the member 111. Furthermore, the member 111 can include one or more weight segments 124 in various sizes, shapes and configurations. These and other suitable variations in the materials and design exhibiting the same general desired characteristics are contemplated as coming within the scope of the present invention.

CONCLUSION

Both of the embodiments of the improved racket weighting means of the present invention provide significant advances in the area of weighted sports equipment. The embodiments can be provided in dimensions suitable for use with any of a wide variety of rackets having a shaft with a throat connected to a frame during warm-up, practice or actual play in sports such as tennis, badminton, squash and the like. Also, the devices can be provided with a wide variety of supplemental weights so that the user can select an improved racket weighting means adapted to his particular needs. Finally, more than one of the devices can be attached to a racket at the same time so that the user has greater flexibility in selecting a combination of improved racket weighting means adapted to his particular needs.

The improved racket weighting means clearly provides a highly useful and effective device for use with any existing racket having a shaft with a throat connected to a frame during warm-up, practice or actual play for temporarily adding supplemental weight in order to develop a better shot by controlling the moment of inertia, center of balance, weighting, flexibility and other physical properties of the racket to strengthen the critical parts of the arm.

While I have shown and described two specific embodiments of the improved racket weighting means for purposes of illustration only, it is to be understood that the invention is to be limited solely by the scope of the appended claims.

I claim:

1. An improved racket weighting means for use with a racket having a shaft with a throat connected to a frame, comprising:

a. a first segment consisting essentially of a non-continuous flexible, substantially inelastic elongated member having opposed ends and adapted to be wrapped at least one time around the shaft of said racket, b. a supplemental weight integrally associated with said elongated member, c. a second segment for attaching said first segment to the racket consisting essentially of a non-continuous supple member extending from one of said opposed ends of said elongated member, said supple member being of a sufficient length and sufficient suppleness to be wrapped at least one time around the shaft of said racket, with said first segment and said supplemental weight wrapped around the shaft of said racket and said supple member overlying and extending snuggly about said first segment and said supplemental weight, and d. fastening means to affix said second segment about said first segment to immobily seat the racket weighting means about the shaft of the racket.

2. The improved racket weighting means of claim 1 in which said member includes at least one weight segment and said supplemental weight is internally disposed in said weight segment.

3. The improved racket weighting means of claim 1 in which said supple member includes a first portion attached to said elongated member in longitudinal alignment.

4. The improved racket weighting means of claim 3 in which one side of said supple member includes a first fastener portion, and the other side of said supple member includes a second fastener portion, said fastener portions together cooperatively forming said fastening means.

5. The improved racket weighting means of claim 4 in which at least the first portion of said supple member is a flexible, elastic material.

* * * * *